US007261337B2

(12) United States Patent
Nakagome et al.

(10) Patent No.: US 7,261,337 B2
(45) Date of Patent: Aug. 28, 2007

(54) HOOD LATCH DEVICE FOR MOTOR VEHICLE

(75) Inventors: Katsumi Nakagome, Yokohama (JP); Shingo Kiyono, Tokyo (JP)

(73) Assignee: Ohi Seisakusho Co., Ltd., Kanagawa (JP)

( * ) Notice: Subject to any disclaimer, the term of this patent is extended or adjusted under 35 U.S.C. 154(b) by 130 days.

(21) Appl. No.: 10/862,407

(22) Filed: Jun. 8, 2004

(65) Prior Publication Data

US 2004/0256861 A1 Dec. 23, 2004

(30) Foreign Application Priority Data

Jun. 9, 2003 (JP) ..... 2003-163421

(51) Int. Cl.
*E05C 3/06* (2006.01)
*E05C 3/16* (2006.01)

(52) U.S. Cl. ..... 292/216; 292/95; 292/304; 292/DIG. 14

(58) Field of Classification Search ..... 292/216, 292/11, 304, 341.12, DIG. 14, DIG. 56, 95
See application file for complete search history.

(56) References Cited

U.S. PATENT DOCUMENTS 2,877,038 A * 3/1959 Kramer ..... 292/216
2,924,473 A * 2/1960 Krause ..... 292/11
3,572,793 A * 3/1971 Cole ..... 292/216
3,905,624 A * 9/1975 Fujita ..... 292/11
4,045,064 A * 8/1977 Okada ..... 292/125
4,478,441 A * 10/1984 Fiordellisi et al. ..... 292/216
4,875,724 A * 10/1989 Gruber ..... 292/216
4,896,907 A * 1/1990 Hayakawa et al. ..... 292/216
4,936,611 A * 6/1990 Palvolgyi ..... 292/28
4,961,601 A * 10/1990 Lindholm et al. ..... 292/216
5,048,877 A * 9/1991 Rogers et al. ..... 292/110
5,348,355 A * 9/1994 Oyha ..... 292/11
5,445,421 A * 8/1995 Ferrara ..... 292/216
5,618,069 A * 4/1997 Konchan et al. ..... 292/216
5,738,393 A * 4/1998 Chao ..... 292/216
5,853,060 A * 12/1998 Chao et al. ..... 180/69.2
6,012,747 A * 1/2000 Takamura et al. ..... 292/216
6,106,033 A * 8/2000 Ruckert ..... 292/216
6,109,670 A * 8/2000 Tomaszewski et al. ..... 292/216
6,422,616 B1 * 7/2002 Wortmann et al. ..... 292/216
6,581,987 B1 * 6/2003 Gentile et al. ..... 292/216
6,666,483 B2 * 12/2003 Baniak et al. ..... 292/123
6,695,360 B1 * 2/2004 Forsell et al. ..... 292/216

FOREIGN PATENT DOCUMENTS

JP 2229376 * 9/1990
JP 2232487 * 9/1990
JP 6-25506 B2 4/1994

* cited by examiner

*Primary Examiner*—Carlos Lugo
(74) *Attorney, Agent, or Firm*—Sughrue Mion, PLLC

(57) ABSTRACT

A hood latch device for a vehicle comprises a base plate secured to a vehicle body. A striker is secured to a pivotal hood of the vehicle body. A primary latch plate and a locking plate are pivotally connected a rear surface of the base plate and engageable with the striker to permit the hood to have a locked full-close position and a released open position. A secondary latch plate is pivotally connected to a front surface of the base plate and engageable with the striker to permit the hood to have a slightly open position and the released open position. A first stopper is arranged to stop an excessive pivoting of the secondary latch plate by contacting a given part of the secondary latch plate. The first stopper is provided by bending an end portion of the base plate without producing an opening therethrough.

11 Claims, 3 Drawing Sheets

HOOD LATCH DEVICE FOR MOTOR VEHICLE

BACKGROUND OF THE INVENTION

1. Field of the Invention

The present invention relates in general to latch devices, and more particularly to latch devices which can latch a hood of a motor vehicle to a body of the same.

2. Description of the Related Art

Hitherto, various hood latch devices have been proposed and put into a practical use particularly in the field of wheeled motor vehicles. One of them is disclosed in Japanese Patent Second Provisional Publication (Tokkouhei) 6-25506. In the hood latch device of this publication, to a base plate secured to a center stay of an engine room, there are pivotally connected a primary latch plate which can latch a striker of an engine room hood, a locking plate which can lock the primary latch plate at the latch position thereby to lock the hood in a full-close position, and a secondary latch plate which can hold the hood in a slightly open position.

SUMMARY OF THE INVENTION

In the hood latch device of the provisional patent, the primary latch plate and the locking plate are placed on a rear surface of the base plate and the secondary latch plate is placed on a front surface of the base plate. For stopping an excessive pivoting of these three plates, respective stoppers are provided on the rear and front surfaces of the base plate. These stoppers are provided by pressing out of the base plate, and thus, respective openings of certain size are inevitably left in the base plate as a result of such pressing work.

However, provision of such through openings of certain size in the base plate tends to induce not only reduction in mechanical strength of the base plate but also apprehension about security (viz., anti-theft ability) of the vehicle. That is, the through openings of the base plate have a certain possibility of receiving a picking tool from the outside of the vehicle. If the locking plate of the hood latch device is tampered to be moved to an unlock position by the picking tool manipulated by an illegal person, the hood is easily opened by him or her.

The present invention is provided by taking the above-mentioned drawbacks of the related art into consideration and aims to provide a hood lock device which has an improved anti-theft ability.

According to the present invention, there is provided a hood latch device of a motor vehicle, which comprises a base plate, a primary latch plate, a locking plate and a secondary latch plate which are pivotally connected to the base plate, and stoppers which function to stop an excessive pivoting of these three plates, wherein the stoppers are produced on the base plate without producing through openings in the base plate.

In accordance with a first aspect of the present invention, there is provided a hood latch device for a vehicle having a hood pivotally connected to a body of the vehicle. The hood latch device comprises a base plate secured to one of the vehicle body and the hood, the base plate having front and rear surfaces; a striker secured to other one of the vehicle body and the hood; a primary latch plate pivotally connected to the base plate and pivotal over the rear surface of the base plate between a latch position to latch the striker and an unlatch position to release the striker; a locking plate pivotally connected to the base plate and pivotal over the rear surface of the base plate between a locking position to lock the primary latch plate at the latch position and an unlocking position to release the primary latch plate; an secondary latch plate pivotally connected to the base plate and pivotal over the front surface of the base plate between an engaging position to engage with the striker causing the hood to take a slightly open position and a disengaging position to release the striker permitting the hood to take an open position; and a first stopper which stops an excessive pivoting of the secondary latch plate by contacting a given part of the secondary latch plate, the first stopper being provided by bending an end portion of the base plate without producing an opening therethrough.

In accordance with a second aspect of the present invention, there is provided a hood latch device for a vehicle having a hood pivotally connected to a body of the vehicle. The hood latch device comprises a base plate secured to one of the vehicle body and the hood, the base plate having front and rear surfaces; a striker secured to other one of the vehicle body and the hood; a primary latch plate pivotally connected to the rear surface of the base plate to pivot between a latch position to latch the striker and an unlatch position to release the striker; a locking plate pivotally connected to the rear surface to pivot between a locking position to lock the primary latch plate at the latch position and an unlocking position to release the primary latch plate; a secondary latch plate pivotally connected to the front surface of the base plate to pivot between an engaging position to engage with the striker causing the hood to take a slightly open position and a disengaging position to release the striker permitting the hood to take an open position; a cover plate connected to the rear surface of the base plate in a manner to define therebetween a certain clearance for receiving therein both the primary latch plate and the locking plate; a first stopper which stops an excessive pivoting of the secondary latch plate by contacting a given part of the secondary latch plate, the first stopper being provided by bending a lower end portion of the base plate forward without producing an opening therethrough; a second stopper which stops an excessive pivoting of the locking plate by contacting a given part of the locking plate, the second stopper being provided by bending an upper end portion of the cover plate rearward without producing an opening therethrough; and a third stopper which stops an excessive pivoting of the primary latch plate contacting a given part of the primary latch plate, the third stopper being provided by bending a lower end portion of the cover plate forward without producing an opening therethrough.

BRIEF DESCRIPTION OF THE DRAWINGS

Other objects of the present invention will become apparent from the following description when taken in conjunction with the accompanying drawings, in which.

DETAILED DESCRIPTION OF THE INVENTION

In the following, the present invention will be described in detail with reference to the drawings.

For ease of understanding, various directional terms, such as, front, rear, upper, lower, forward, rearward and the like are used in the following description. However, such terms are to be understood with respect to a motor vehicle which has a hood latch device of the present invention installed therein.

Furthermore, it is to be noted that an engine room hood (or hood) incorporated with the hood latch device of the invention is of a type which has a rear end hinged to a body of the vehicle. That is, the hood opens at a front side.

Figure 2:
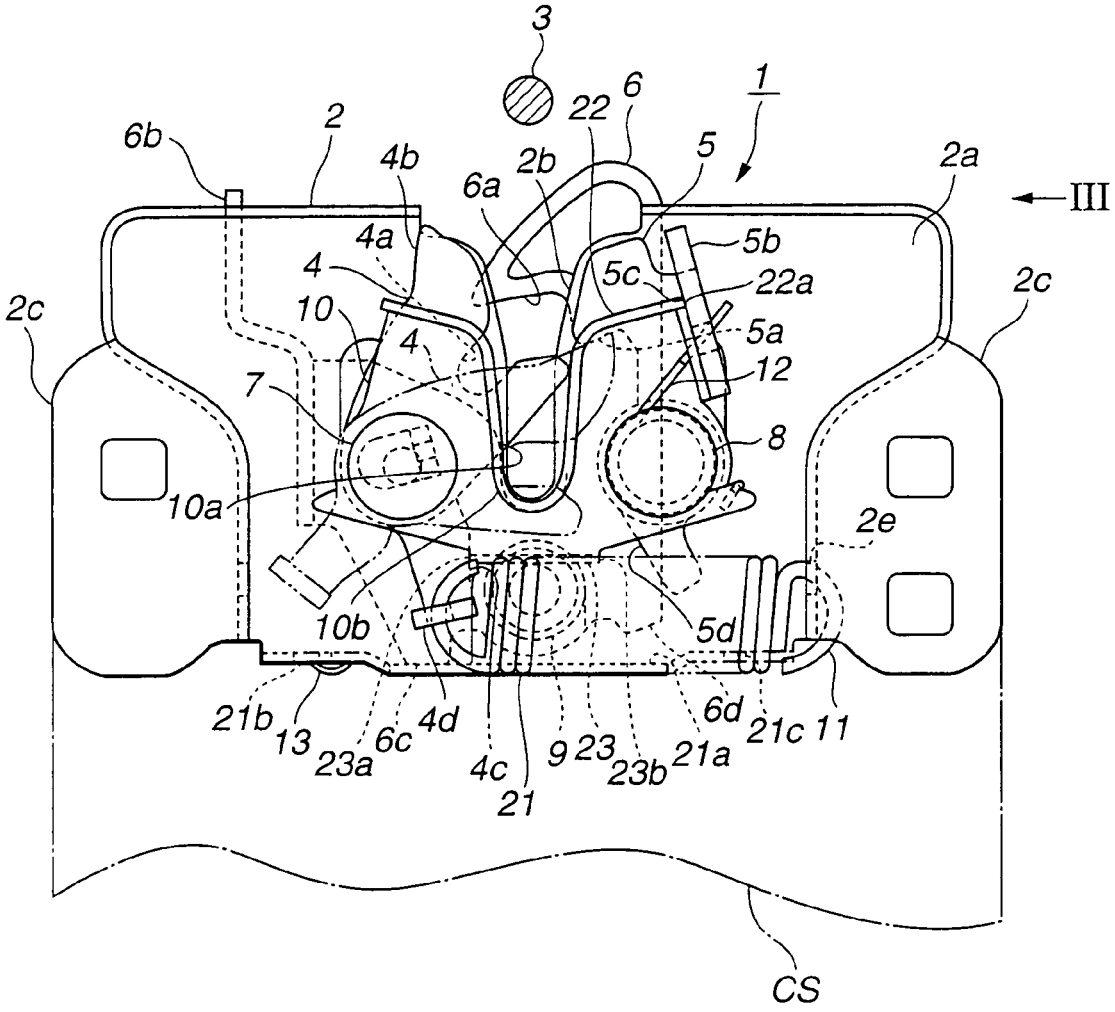
FIG. 2 is a rear view of the hood latch device of the present invention, which is taken from a rear position of the associated is motor vehicle.

Referring to the drawings, particularly FIG. 2 which is a view taken from a rear position of an associated motor vehicle, there is shown a hood latch device 1 of the present invention.

The hood latch device 1 comprises a base plate 2 of metal which is secured through bolts (not shown) to a center stay "CS" located at a front and center position of an engine room.

To the base plate 2, there are pivotally connected three plates which are a primary latch plate 4, a locking plate 5 and a secondary latch plate 6.

More specifically, the primary latch plate 4 and the locking plate 5 are pivotally connected to a rear surface 2*a* of the base plate 2 and the secondary latch plate 6 is pivotally connected to a front surface 2*d* of the base plate 2.

The primary latch plate 4 is engageable with a striker 3 which is secured to a front lower portion of the hood. As is described hereinabove, the hood has a rear end hinged to the vehicle body, so that the hood opens at a front side. When the hood taking an open position is pivoted down, the striker 3 is brought into engagement with the primary latch plate 4 turning the same to a latch position (which is indicated by a broken line in FIG. 2) to cause the hood to take a full-close position. When the primary latch plate 4 is turned to the latch position, the locking plate 5 becomes operatively engaged with the primary latch plate 4 to lock the same at the latch position. Thus, in this case, the hood is locked at the full-close position.

As will be described in detail hereinafter, when the secondary latch plate 6 is engaged with the striker 3, the hood assumes a slightly open position.

Figure 3:
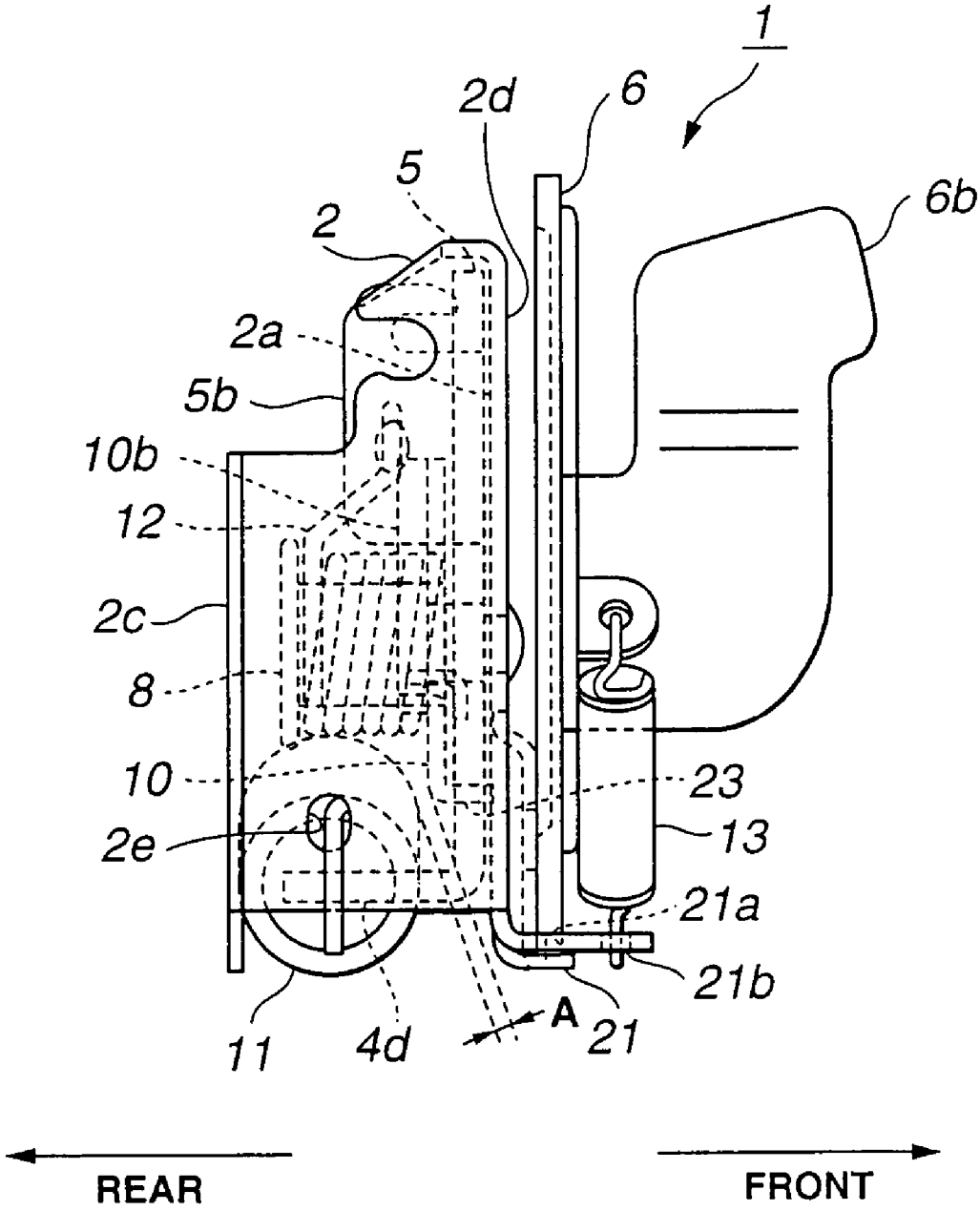
FIG. 3 is a side view of the hood latch device of the present invention, which is taken from the direction of the arrow "III" of FIG. 1 or FIG. 2.

As is understood from FIGS. 2 and 3, a cover plate 10 is secured through two shafts 7 and 8 to the rear surface 2*a* of the base plate 2 in a manner to define therebetween a certain clearance. More specifically, the certain clearance is defined between the rear surface 2*a* of the base plate 2 and a front surface of the cover plate 10.

The primary latch plate 4 and the locking plate 5 are both received in the certain clearance while being pivotally held by the respective shafts 7 and 8.

Figure 1:
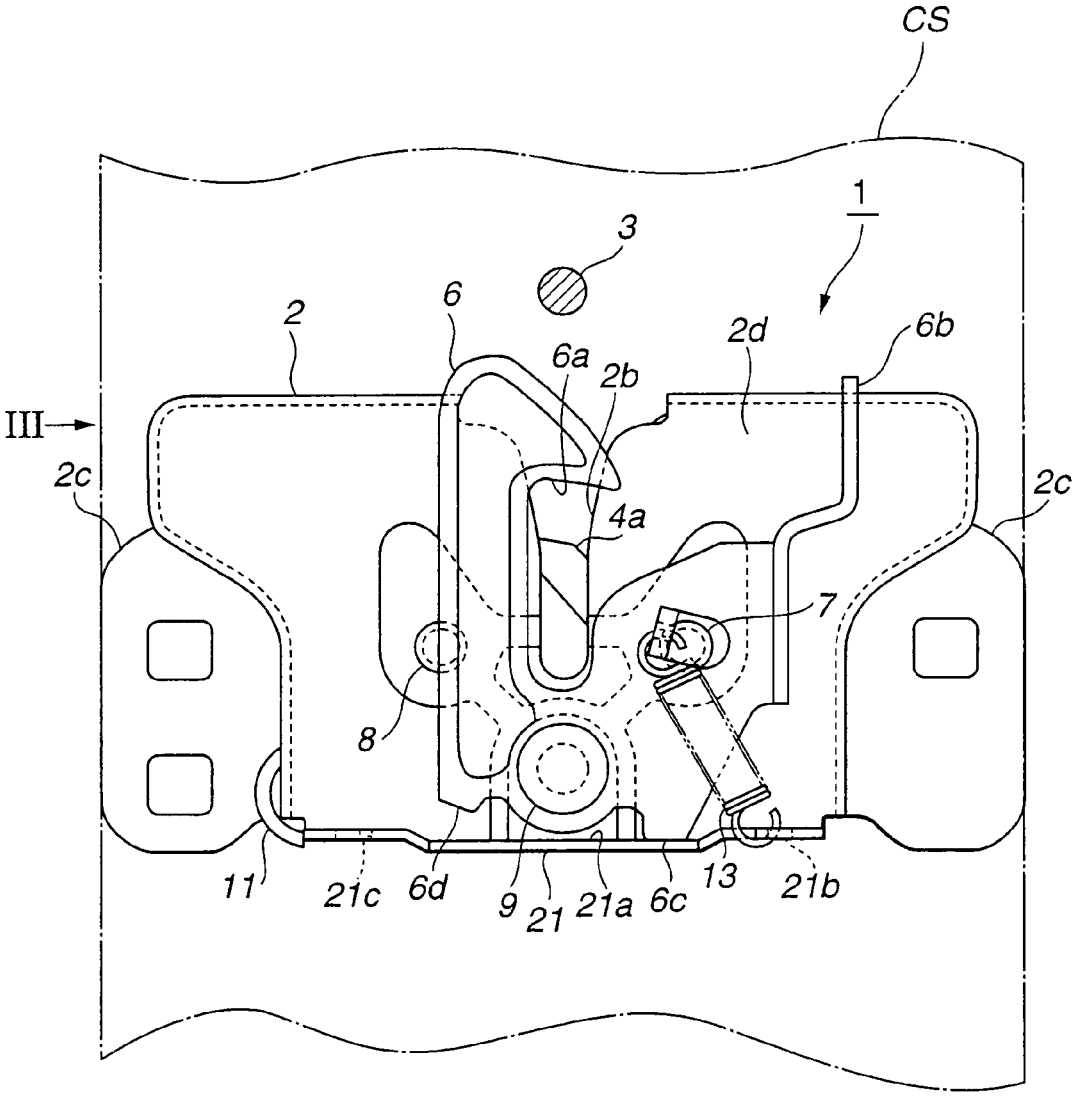
FIG. 1 is a front view of a hood latch device of the present invention, which is taken from a front position of an associated motor vehicle.

As is understood from FIG. 1, when viewed from a front position of the vehicle, the shaft 7 of the primary latch plate 4 and the shaft 8 of the locking plate 5 are respectively positioned at right and left portions of the base plate 2 with respect to a striker receiving recess 2*b* formed in a generally middle portion of the base plate 2.

Referring back to FIG. 2, the base plate 2 is formed with right and left wing portions 2*c* which are secured to the center stay "CS" by bolts (not shown). The base plate 2 has further the above-mentioned striker receiving recess 2*b* which has an enlarged triangular inlet portion at its upper part for smoothly receiving the striker 3.

Furthermore, the base plate 2 is formed with a first bent portion 21 (see FIG. 3) which is provided by bending a lower part of the base plate 2 forwardly.

As is seen from FIGS. 1 and 2, the first bent portion 21 has a generally center area positioned just below the striker receiving recess 2*b*. With this positioning of the first bent portion 21, the rigidity of the lower part of the base plate 2 is increased, which is quite advantageous because a high stress is applied to such lower part when the striker 3 abuts against the bottom of the striker receiving recess 2*b* in response to closing of the hood.

Although not well shown in the drawings, the cover plate 10 has a symmetrical shape and has at a generally middle part a striker receiving recess 10*a* which is overlapped with the striker receiving recess 2*b* of the base plate 2 to constitute a so-called striker receiving recess structure.

Furthermore, the cover plate 10 has a second bent portion 22 which is provided by bending an upper end portion of the cover plate 10 rearward, and a third bent portion 23 which is provided by bending a lower end portion of the cover plate 10 forward, that is, toward a major part of the base plate 2 (see FIG. 3).

As is seen from FIG. 2, the second bent portion 22 is integral with a rearward bent flange 10*b* which extends along an edge of the striker receiving recess 10*a* of the cover plate 10. With this arrangement, the rigidity of the upper portion of the cover plate 10 is increased.

As is seen from FIG. 2, the third bent portion 23 has a generally center area positioned just below the striker receiving recess 10*a*. With this arrangement, the rigidity of the lower part of the cover plate 10 is increased.

As is seen from FIG. 2, the primary latch plate 4 is formed with both a striker catching recess 4*a* which is engageable with the striker 3 and an engaging portion 4*b* which is engageable with a pawl portion 5*a* of the locking plate 5. That is, when, upon closing of the hood, the striker 3 is brought into engagement with the striker catching recess 4*a*, the primary latch plate 4 is turned in a clockwise direction in FIG. 2 against a biasing force of a tension coil spring 11 from an unlatch position indicated by a solid line toward the above-mentioned latch position causing the hood to take the full-close position. Upon reaching the latch position, primary latch plate 4 is locked by the locking plate 5 having the engaging portion 4*b* engaged with the pawl portion 5*a* of the locking plate 5. Upon this, the hood is locked at the full-close position.

The primary latch plate 4 is formed at its lower portion with a contacting edge 4*c* which is brought into contact with an edge 23*a* of the third bent portion 23 when the primary latch plate 4 is returned to the unlatch position.

That is, the edge 23*a* of the third bent portion 23 serves as a third stopper which prevents an excessive pivoting of the primary latch plate 4.

The tension coil spring 11 is a coil spring which has one end hooked to a bent portion 4*d* formed on a lower part of the primary latch plate 4 and the other end hooked to an engaging opening 2*e* formed in a side wall of the base plate 2.

As is seen from FIGS. 2 and 3, a multi-turned middle portion of the tension coil spring 11 is placed behind a lower part of the base plate 2, and arranged to cover a space "A" which is defined between the multi-turned middle portion and the lower end of the cover plate 10.

As is understood from FIG. 3, since the third portion 23 of the cover plate 10 extends toward the base plate 2, the tension coil spring 11 can be positioned close to the cover plate 10, which brings about a compact construction of the hood latch device of the invention.

As is seen from FIG. 2, the locking plate 5 is formed with the above-mentioned pawl portion 5*a* which is engageable with the engaging portion 4*b* of the primary latch plate 4 and a connecting portion 5*b* which is connected through a cable (not shown) to an opener handle (not shown) installed near a driver's seat.

When the opener handle is pulled or manipulated, the locking plate 5 is pivoted clockwise in FIG. 2 from a locking position as shown in FIG. 2 wherein a side surface 5*c* of the connecting portion 5*b* contacts an edge 22*a* of the second bent portion 22 of the cover plate 10 toward or to an unlocking position wherein a contacting portion 5*d* of the locking plate 5 contacts a right edge 23*b* of the third bent portion 23 of the cover plate 10. That is, as will become apparent hereinafter, when the opener handle is pulled, the locking plate 5 is turned in a direction to release the primary latch plate 4 from the locked condition.

That is, the edge 22*a* of the second bent portion 22 and the edge 23*a* of the third bent portion 23 serve as second and fourth stoppers which prevent an excessive pivoting of the locking plate 5.

As is seen from FIGS. 2 and 3, a torsion coil spring 12 is disposed about the shaft 8 to bias the locking plate 5 in a counterclockwise direction in FIG. 2, that is, in a direction to take the locking position. One end of the torsion coil spring 12 is hooked to the locking plate 5 and the other end of the same is hooked to the cover plate 10.

As is seen from FIGS. 1 and 3, the secondary latch plate 6 is arrange at the front surface 2*d* of the base plate 2, unlike the above-mentioned primary latch plate 4 and locking plate 5. That is, as is seen from FIG. 1, the secondary latch plate 6 is pivotally disposed on a shaft 9 secured to a lower portion of the base plate 2. As shown, the shaft 9 is positioned just below the striker receiving recess 2*b* of the base plate 2.

As shown in FIG. 1, the secondary latch plate 6 is formed with a hook portion 6*a* which engages with the striker 3 when the hood takes the slightly open position and a handle portion 6*b* which can be manipulated by an operator's hand which gets into a little clearance defined between the vehicle body and a front end of the slightly open hood. The secondary latch plate 6 has further a first contacting portion 6*c* which is provided at a right lower end of the plate 6 and a second contacting portion 6*d* which is provided at a left lower end of the plate 6. That is, when the handle portion 6*b* is pushed leftward in the drawing, the secondary latch plate 6 is pivoted in a counterclockwise direction about the shaft 9 from an engaging position wherein, as shown in the drawing, the first contacting portion 6*c* contacts an upper surface 21*a* of the first bent portion 21 toward or to a disengaging position wherein the second contacting portion 6*d* contacts the upper surface 21*a* of the first bent portion 21. When the secondary latch plate 6 is in the engaging position, the hook portion 6*a* can catch the striker 3 to hold the hood at the slightly open position. While, when the secondary latch plate 6 is in the disengaging position, the hook portion 6*a* releases the striker 3 causing the hood to be fully released from the hood latch device 1. Thus, if, under this fully released condition, an external force is applied to the hood by a person in a direction to open the hood, the hood can be opened.

Thus, the upper surface 21*a* of the first bent portion 21 serves as a first stopper which prevents an excessive pivoting of the secondary latch plate 6.

As is seen from FIG. 1, the secondary latch plate 6 is biased to take the engaging position by a tension coil spring 13 which has one end hooked to the secondary latch plate 6 and the other end hooked to a catch portion 21*b* formed on a right end of the first bent portion 21. In the illustrated embodiment, another catch portion 21*c* is formed on a left end of the first bent portion 21. Thus, the first bent portion 21 has a symmetrical shape. If the secondary latch plate 6 takes an arrangement opposite to the illustrated arrangement, the catch portion 21*c* is used for hooking one end of the tension coil spring 13.

It is now to be noted that due to provision of the catch portions 21*b* and 21*c* on the first bent portion 21 of the base plate 2, there is no need of providing the base plate 2 with pressed out portions for hooking one end of the tension coil spring 13.

In the following, operation of the hood latch device 1 of the present invention will be briefly described with reference to the drawings.

For ease of understanding, explanation on the fully closed and locked condition of the hood will be commenced.

Under this condition, the primary latch plate 4 takes the latch position and locked by the locking plate 5, and the secondary latch plate 6 takes the engaging position as shown in FIG. 1. It is to be noted, under this condition, the striker 3 latched by the primary latch plate 4 is free from the hook portion 6*a* of the secondary latch plate 6. In other words, there is left a certain clearance between the latched striker 3 and the hook portion 6*a* of the secondary latch plate 6.

When, for the purpose of opening the hood, the opener handle located near the driver's seat is pulled, the locking plate 5 is pivoted from the locking position to the unlocking position releasing the primary latch plate 4. Upon this, the primary latch plate 4 is pivoted from the latch position to the unlatch position with the aid of the biasing force of the tension coil spring 11.

Thus, the striker 3 is moved upward together with the hood in response to the turning of the primary latch plate 4 from the latch position to the unlatch position while being released from the striker catching recess 4*a* of the primary latch plate 4. However, as will be seen from FIG. 1, such upward movement of the striker 3 is stopped by the hook portion 6*a* of the secondary latch plate 6 which is in the engaging position. Thus, under this condition, the hood is forced to take the slightly open position forming a little clearance between the vehicle body and the front end of the slightly open hood.

When now, as will be seen from FIG. 1, the handle portion 6*b* of the secondary latch plate 6 is moved leftward by the operator's hand which gets into the little clearance from the outside of the vehicle, the secondary latch plate 6 is pivoted counterclockwise about the shaft 9 releasing the striker 3 from the hook portion 6*a*. Thus, when, thereafter, applied with a certain lifting force, the hood can be pivoted upward toward its full-open position. A stand bar (not shown) may be used for keeping the hood at the full-open position.

Under this condition, as is seen from FIG. 2, the primary latch plate 4 is forced to take the unlatch position due to the force of the tension coil spring 11 and the locking plate 5 is forced to take the locking position (more specifically, faked locking position) due to the force of the torsion coil spring 12, and as is seen from FIG. 1, the secondary latch plate 6 is forced to take the engaging position (more specifically, faked engaging position).

When, now, as will be seen from FIG. 1, the stand bar is unfastened and the hood is pivoted down, the striker 3 of the hood abuts against a rounded head of the hook portion 6*a* of the secondary latch plate 6 pivoting the secondary latch plate 6 in a counterclockwise direction against the force of the tension coil spring 13. With this, the striker 3 is permitted to enter the striker receiving recess structure which includes the striker receiving recess 2*b* of the base plate 2 and the striker receiving recess 10*a* of the cover plate 10. Upon disengagement of the striker 3 from the rounded head of the hook portion 6*a*, the secondary latch plate 6 is turned to the engaging position due to the force of the tension coil spring 13.

As will be seen from FIG. 2, the striker 3 which has just entered the striker receiving recess structure is brought into engagement with the primary latch plate 4 (more specifically, the striker catching recess 4*a* of the plate 4) pivoting the same in a clockwise direction to the latch position. During this, the engaging portion 4*b* of the primary latch plate 4 becomes engaged with the pawl portion 5*a* of the locking plate 5 causing the primary latch plate 4 to be locked at the latch position by the locking plate 5. Thus, the hood is brought to the fully closed locked position.

In the following, features of the present invention will be described.

(1) The first stopper 21*a* for suppressing an excessive pivoting of the secondary latch plate 6 is the upper surface 21*a* of the first bent portion 21 which is provided by bending the lower part of the base plate 2 forward.

(2) The second and fourth stoppers 22*a* and 23*b* for suppressing an excessive pivoting of the locking plate 5 are the respective edges 22*a* and 23*b* of the second and third bent portions 22 and 23 which are integrally provided by the cover plate 10.

(3) The third stopper 23*a* for suppressing an excessive pivoting of the primary latch plate 4 is the edge 23*a* of the third bent portion 23 which is integrally provided by the cover plate 10.

With the above-mentioned first, second, third and fourth stoppers 21*a*, 22*a*, 23*a* and 23*a*, there is no need of providing the base plate 2 with pressed out portions for preparation of stoppers like in the case of the above-mentioned Japanese Second Provisional Patent (Tokkaihei) 6-25506. That is, in accordance with the present invention, the base plate 2 is suppressed from having various openings which would cause apprehension about security (viz., anti-theft ability) of the vehicle.

In the above-mentioned embodiment, the description is directed to an arrangement wherein the striker 3 is secured to the hood and the hood latch device 1 is connected to the vehicle body. However, if desired, a reversed arrangement may be employed in which the striker 3 is connected to the vehicle body and the hood latch device 1 is connected to the hood.

The entire contents of Japanese Patent Application 2003-163421 filed Jun. 9, 2003 are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. A hood latch device for a vehicle having a hood pivotally connected to a body of the vehicle, comprising:

a base plate secured to one of the vehicle body and the hood, the base plate having front and rear surfaces;

a striker secured to other one of the vehicle body and the hood;

a primary latch plate pivotally connected to the base plate and pivotal over the rear surface of the base plate between a latch position to latch the striker and an unlatch position to release the striker;

a locking plate pivotally connected to the base plate and pivotal over the rear surface of the base plate between a locking position to lock the primary latch plate at the latch position and an unlocking position to release the primary latch plate;

an secondary latch plate pivotally connected to the base plate and pivotal over the front surface of the base plate between an engaging position to engage with the striker causing the hood to take a slightly open position and a disengaging position to release the striker permitting the hood to take an open position; and a first stopper which stops an excessive pivoting of the secondary latch plate by contacting a given part of the secondary latch plate, the first stopper being a bent and uncut portion along an edge of an end portion of the base plate, further comprising:

a cover plate which is connected to the rear surface of the base plate to define therebetween a certain clearance for receiving therein both the primary latch plate and the locking plate; and a second stopper which stops an excessive pivoting of the locking plate by contacting a given part of the locking plate, the second stopper being a bent and uncut portion along an edge of an end portion of the cover plate.

2. A hood latch device as claimed in claim 1, in which the second stopper is integral with a flange which extends along an edge of a striker receiving recess formed in the cover plate.

3. A hood latch device as claimed in claim 1, further comprising a third stopper which stops an excessive pivoting of the primary latch plate by contacting a given part of the primary latch plate, the third stopper being a bent and uncut portion along an edge of another end portion of the cover plate.

4. A hood latch device as claimed in claim 1, in which the bent portion of the cover plate which constitutes the second stopper has an edge to which the given part of the locking plate is contactable.

5. A hood latch device as claimed in claim 3, in which the bent portion of the cover plate which constitutes the third stopper has an edge to which the given part of the primary latch plate is contactable.

6. A hood latch device for a vehicle having a hood pivotally connected to a body of the vehicle, comprising:

a base plate secured to one of the vehicle body and the hood, the base plate having front and rear surfaces;

a striker secured to other one of the vehicle body and the hood;

a primary latch plate pivotally connected to the base plate and pivotal over the rear surface of the base plate between a latch position to latch the striker and an unlatch position to release the striker;

a locking plate pivotally connected to the base plate and pivotal over the rear surface of the base plate between a locking position to lock the primary latch plate at the latch position and an unlocking position to release the primary latch plate;

an secondary latch plate pivotally connected to the base plate and pivotal over the front surface of the base plate between an engaging position to engage with the striker causing the hood to take a slightly open position and a disengaging position to release the striker permitting the hood to take an open position; and a first stopper which stops an excessive pivoting of the secondary latch plate by contacting a given part of the secondary latch plate, the first stopper being a bent and uncut portion along an edge of an end portion of the base plate, in which the bent portion of the base plate which constitutes the first stopper is positioned below a striker receiving recess provided in the base plate.

7. A hood latch device for a vehicle having a hood pivotally connected to a body of the vehicle, comprising:

a base plate secured to one of the vehicle body and the hood, the base plate having front and rear surfaces;

a striker secured to other one of the vehicle body and the hood;

a primary latch plate pivotally connected to the base plate and pivotal over the rear surface of the base plate between a latch position to latch the striker and an unlatch position to release the striker;

a locking plate pivotally connected to the base plate and pivotal over the rear surface of the base plate between a locking position to lock the primary latch plate at the latch position and an unlocking position to release the primary latch plate;

an secondary latch plate pivotally connected to the base plate and pivotal over the front surface of the base plate between an engaging position to engage with the striker causing the hood to take a slightly open position and a disengaging position to release the striker permitting the hood to take an open position; and a first stopper which stops an excessive pivoting of the secondary latch plate by contacting a given part of the secondary latch plate, the first stopper being a bent and uncut portion along an edge of an end portion of the base plate, in which the bent portion of the base plate which constitutes the first stopper is provided with a spring catch portion which catches one end of a spring by which the secondary latch plate is biased to pivot in a given direction.

8. A hood latch device for a vehicle having a hood pivotally connected to a body of the vehicle, comprising:

a base plate secured to one of the vehicle body and the hood, the base plate having front and rear surfaces;

a striker secured to other one of the vehicle body and the hood;

a primary latch plate pivotally connected to the rear surface of the base plate to pivot between a latch position to latch the striker and an unlatch position to release the striker;

a locking plate pivotally connected to the rear surface to pivot between a locking position to lock the primary latch plate at the latch position and an unlocking position to release the primary latch plate;

a secondary latch plate pivotally connected to the front surface of the base plate to pivot between an engaging position to engage with the striker causing the hood to take a slightly open position and a disengaging position to release the striker permitting the hood to take an open position;

a cover plate connected to the rear surface of the base plate in a manner to define therebetween a certain clearance for receiving therein both the primary latch plate and the locking plate;

a first stopper which stops an excessive pivoting of the secondary latch plate by contacting a given part of the secondary latch plate, the first stopper being a bent and uncut portion along an edge of a lower end portion of the base plate forward;

a second stopper which stops an excessive pivoting of the locking plate by contacting a given part of the locking plate, the second stopper being a bent and uncut portion along an edge of an upper end portion of the cover plate rearward; and a third stopper which stops an excessive pivoting of the primary latch plate contacting a given part of the primary latch plate, the third stopper being a bent and uncut portion along an edge of a lower end portion of the cover plate forward.

9. A hood latch device as claimed in claim 8, in which the base plate and the cover plate are respectively formed with vertically extending recesses which are overlapped with each other to constitute a striker receiving recess which can receive the striker.

10. A hood latch device as claimed in claim 9, in which the upper bent end portion of the cover plate which constitutes the second stopper is integral with a flange which extends along an edge of the vertically extending recess of the cover plate.

11. A hood latch device as claimed in claim 8, in which the base plate and the cover plate have given portions in the vicinity of the striker receiving recess, the given portions being free of uncovered openings except the vertically extending recesses of the base plate and the cover plate.

* * * * *